United States Patent [19]

Goldade

[11] 4,312,161

[45] Jan. 26, 1982

[54] LOG-JOINT SYSTEM

[76] Inventor: Sebastian M. Goldade, General Delivery, Grande Prairie, Alberta, Canada, T8V 2Z7

[21] Appl. No.: 115,979

[22] Filed: Jan. 28, 1980

[30] Foreign Application Priority Data

Feb. 28, 1979 [CA] Canada ..... 322509

[51] Int. Cl.[3] ..... E04B 1/10

[52] U.S. Cl. ..... 52/233; 52/593

[58] Field of Search ..... 46/25, 28, 20; 52/233, 52/593, 574, 592, 730, 720, 738; 405/16, 31, 284, 286; 403/284, 375; 160/229 R

[56] References Cited

U.S. PATENT DOCUMENTS 1,942,348 1/1934 Ward ..... 52/593
1,971,010 8/1934 Korn ..... 52/592
2,005,921 6/1935 Reither ..... 52/233
3,350,824 11/1967 Wiebusch ..... 52/595

FOREIGN PATENT DOCUMENTS 88418 6/1958 Netherlands ..... 52/574

*Primary Examiner*—John E. Murtagh
*Attorney, Agent, or Firm*—Rogers, Bereskin & Parr

[57] ABSTRACT

A method of shaping elongate cylindrical structural members so they can be interfitted to build walls or similar structures which uses the natural shaping of the member in interfitting surfaces and involves the cutting of diametrically opposed grooves in the member, each groove involving a single cutting operation and being similarly shaped so as to co-operate with a similar groove and the adjacent circumferential area in other members such that when interfitted to form a wall the logs resist lateral forces.

9 Claims, 4 Drawing Figures

FIG. 1
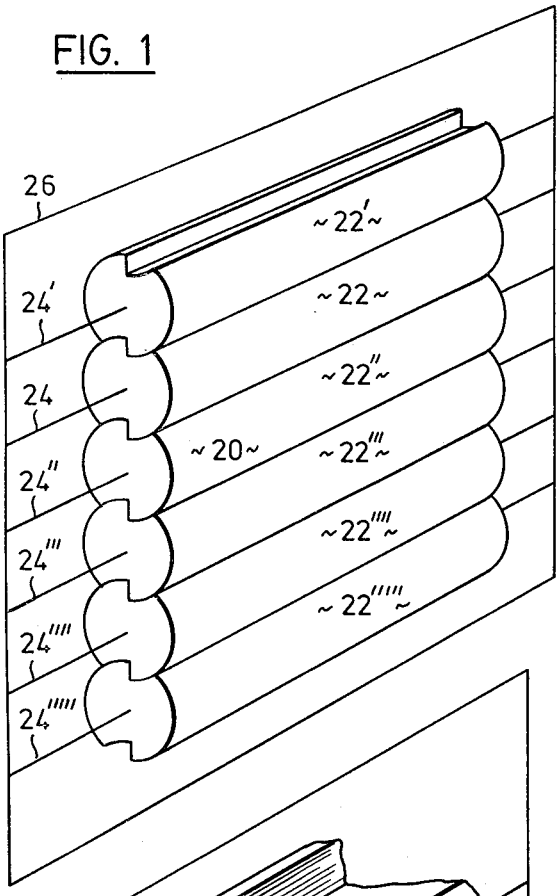
FIG. 2
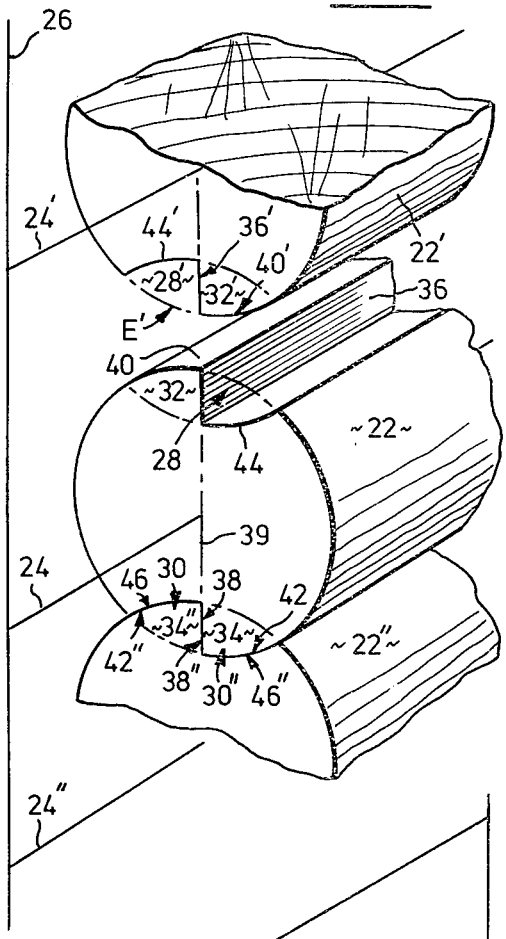
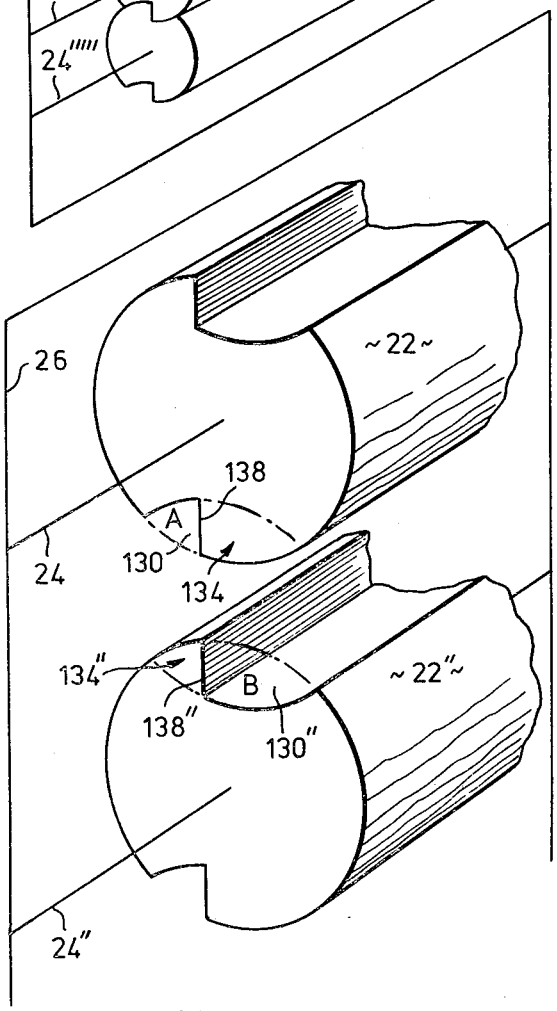
FIG. 3
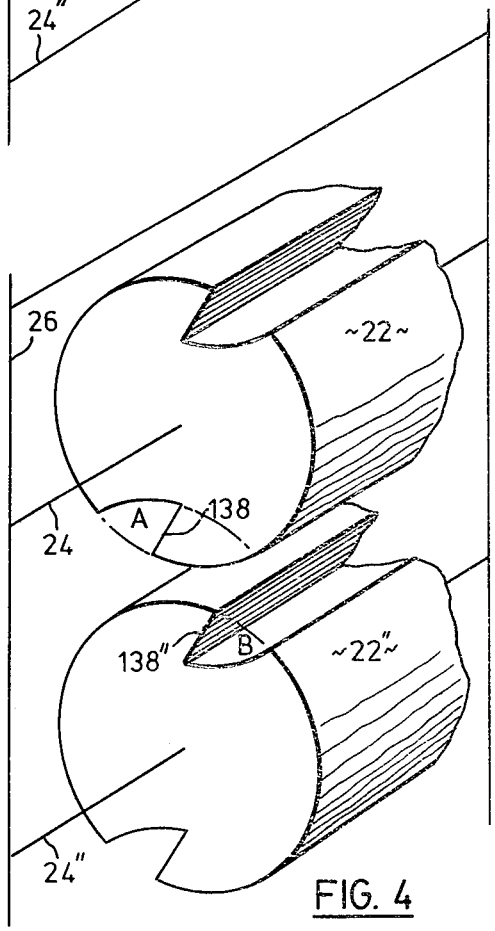
FIG. 4

LOG-JOINT SYSTEM

This invention relates to an elongate structural member shaped for use with other such members in the construction of walls or similar structures formed by interfitting the members side by side.

Walls for log cabins and other similar structures are commonly made by stacking horizontal elongate structural members (usually logs or timbers) on top of one another. Often the adjoining sides of the members are interfitted in order to create a more rigid structure. Ideally, the interfitted structure should resist forces acting perpendicular to a plane containing the longitudinal axes of the members. Accordingly, the adjoining surfaces of the members must be shaped to provide protuberant portions which will not be broken off due to stress concentrations occurring when the interfitted structure resists the perpendicular forces. The adjoining surfaces of the members must be shaped in a manner compatable with the internal structure and composition of the member so that inherent weaknesses of the structure do not create problems while shaping the adjoining surfaces of the member or while handling the member in transport or in construction.

Various shapes have been devised for interfitting elongate structural members. U.S. Pat. No. 1,942,348 to Ward teaches a timber member for use in constructing cabins and similar structures having parallel top and bottom surfaces which are inclined in part relative to the vertical side faces of the timber member, and define respectively a longitudinal notch portion adjacent one side of the top surface of the log and a protruding longitudinal portion on the bottom surface of the log adjacent the same side of the log as the notch. When stacked, the protruding portion on the bottom surface of a first timber member is received in the notch portion in the top surface of a second timber member. The resulting structure may resist forces perpendicular to the plane containing the longitudinal axes of the timber member, but requires differently shaped surfaces to be formed on the top and bottom sides. This results in an asymmetric joint between such members. The protruding longitudinal portion on the bottom surface of the member would be susceptible to cracking and breaking because of its shape and because of the inherent failure mechanisms of wood members when machined with such protrusions.

Canadian Pat. No. 298,588 to Stewart teaches a member for use in a cabin or similar sturcture. The member has symmetric, longitudinal top and bottom surfaces, each of which are stepped to provide a set of vertically displaced upper and lower surface areas, each set of stepped surfaces having longitudinal ridges on the upper surface area and longitudinal grooves on the lower surface area. When interfitted the stepped surfaces and the ridges and grooves of adjacent members cooperate for the purpose of resisting perpendicular forces. Again, however, the member must have its entire upper and lower surfaces shaped to create the interfitting structure.

Canadian Pat. No. 144,673 to Schossow teaches a symmetric joint for wood members. Adjacent members have longitudinal blocks and sockets machined in their adjoining sides which interlock to create a symmetric joint. The entire adjoining surfaces must be machined to a very complex shape. The protruding block of this member would be even more susceptible to breakage than the protruding protion of the member taught by Ward.

The cost of shaping the interfitting surfaces of the members can be minimized by making the joint between the members as simple as possible (i.e. minimizing the amount of machining or shaping of the members). By using the natural shaping of the members in the interfitting surfaces and creating a symmetric joint between the adjoining members removes the necessity of having a different shaping means for adjoining members and allows maximum strength to be maintained in both the member as a whole and in the interengaging parts of the members. Furthermore, by making the structural member symmetric then its use with other such members in construction is simplified because the members may be interfitted in more than one orientation.

Accordingly, in one of its aspects this invention provides a cylindrical structural member of generally uniform cross-section for use with other such members arranged side by side to build walls and other such structures. The member has a pair of longitudinally extending female grooves situated on the member at either end of a diameter line and positioned in similar relationship to and at opposite sides of a plane passing through the centreline of the member and each defining adjacent thereto a longitudinally extending male tongue. The grooves are shaped such that each of the grooves and adjavent male tongues may be interfitted with a female groove and a male tongue in a second similar member which are complimentary to said tongue and groove respectively of the first member.

The resulting structure could resist forces perpendicular to the plane containing the longitudinal axes of the members due to the interaction between the surfaces of the grooves and the external surface of the adjacent member. The process of shaping the member involves only the cutting of similar single grooves on opposite sides of the member.

Further objects and advantages of the invention will appear from the following description, taken together with the accompanying drawings in which:

FIG. 1 is a perspective view of a structure made by interengaging a preferred embodiment of structural members made according to the present invention;

FIG. 2 is an exploded view of part of the structure as shown in FIG. 1.

FIG. 3 is an exploded view of a second embodiment of structural members made according to the invention;

FIG. 4 is an exploded view of a third embodiment of structural members made according to the invention.

Reference is made first to FIG. 1 to describe the use of a preferred embodiment of the invention. A structure 20 is shown made up of identical, interengaged, cylindrical structural members (22, 22', 22'', 22''', etc.) whose longitudinal axes (24, 24', 24'', 24''', etc.) are parallel. The longitudinal axes are all situated in the same plane (26).

The structure of FIG. 1 is capable of resisting forces directed perpendicular to the plane 26 due to the interaction between adjoining members at their abutting surfaces. It should be noted that for every pair of adjoining members a line may be drawn perpendicular to and passing through plane 26 which passes through two portions of one member and through at least one portion of the other member. When the members are interfitted, a male tongue portion 32' of one member rests in a longitudinal female groove 28 defined by the other member. Forces perpendicular to plane 26 are resisted in one direction by abutting vertical faces and in the other direction by the interaction of the male tongue portion of one member and the sides of the groove of the other member. It should be further noted that for each pair of adjoining members there are two sets of such pairs of an interfitting female groove and male tongue.

Reference is made to FIG. 2 to describe in detail a preferred embodiment of the invention illustrated in FIG. 1. For the purpose of better illustrating the embodiment, member 22′ has been vertically separated from member 22. The manner in which the timbers are shaped and the manner in which they then co-operate one with the other will be described by referring to three members 22′, 22 and 22″ positioned top, middle and bottom, as shown in FIG. 2 with each part member including the index corresponding to the member on which it is found.

Member 22 has a pair of longitudinally extending female grooves 28 and 30 which are symmetric about longitudinal axis 24. Female grooves 28 and 30 are preferably defined respectively by flat faces 36 and 38 which are coplanar with a diameter line 39 of member 22, and by curved faces 44 and 46 which extend in opposite directions from said diameter line. Adjacent to each of the grooves 28 and 30 are longitudinally extending male tonge portions 32 and 34 respectively which are formed by reason of the female grooves. The longitudinal male tongues 32 and 34 are respectively defined by the flat face 36 of groove 28 and flat face 38 of groove 30 and the adjacent external surfaces 40 and 42 of the member. The curved faces 44 and 46 of grooves 28 and 30 are arcuate shaped to abut external surfaces 40′ and 42″ of adjoining members. The other timber members are shaped similar to member 22, member 22′ for example having female grooves 28′ and 30′; longitudinally extending male tonge portions 32′ and 34′; groove faces 36′ and 44′ and 38′ and 46′ and adjacent external surfaces 40′ and 42′.

It should be noted that the cross-section of each groove as described above forms one-half of an area of elliptical cross-sectional defined at either end of the diameter line 39 by superimposed circumferential surfaces of two similar adjoining members. This is illustrated in FIG. 2 by ellipitical area E′ in member 22′ and elliptical area E in member 22 both of which are defined by a portion of its own circumferential surface and a corresponding portion of a similar member superimposed thereon. Grooves 28 and 28′ comprise an end half of elliptical areas E and E′ respectively and the cross-sectional areas of both grooves total the cross-sectional area of either elliptical area.

Accordingly, female grooves 28, 28′, 30 and 30″ are shaped as to co-operate with longitudinally extending male tongues 32′, 32, 34″ and 34 respectively. If the members are generally of the same size then grooves 28, 28′, 30 and 30″ may be identically made thereby making longitudinally extending male tongues 32, 32′, 34 and 34″ identical.

In using the timbers shaped according to this invention, the timbers are placed one on top of the other as indicated by timbers 22 and 22″ in FIG. 2. Male tongue portion 34 of timber 22 engages in female groove 30″ of timber 22″ such that external surface 42 of timber 22 abuts and rests on the arcuate groove face 46″ of timber 22, arcuate groove face 46 of timber 22 abuts and rests on external wall 42″ of timber 22″ and the flat groove faces 38 and 38″ abut each other along their length. A similar timber member 22′ is then fitted to the top of member 22 in the same manner to build a vertical structure as shown in FIG. 1. When subjected to forces perpendicular to plane 26, abutting groove faces 38 and 38″ prevent movement in one direction, and the interaction of external surface 42 and arcuate groove face 46″ and external surface 42″ and arcuate groove face 46 resist movement in the opposite direction.

The desired stability has been achieved by the shaping of logs according to this invention and the shaping can be accomplished very simply and cheaply by making two similar diametrically opposed cuts on each timber. The female grooves in each member can be made by using shaping means (i.e. saw or routing blades) along one side of the member, rotating the member 180° about its longitudinal axis and then using the same shaping means along the other side of the member. Alternatively, the female grooves may be shaped simultaneously by using similar shaping means placed 180° apart from each other with respect to the longitudinal axis of the member so as to cut similar longitudinal female grooves on opposite sides of a diameter line.

It will be appreciated that the two single cuts on the timber member need not necessarily be located symetrically on opposite sides of a diameter line. For example, FIG. 3 shows two timbers 22 and 22″ of similar size. Similar elliptical portions have been marked out on one side of each timber by superimposing part of the circumferential surface of the adjoining timber. A result similar to that described above can be achieved by cutting out proportionately shaped female grooves from end portions of the elliptical sections shown. For example, in FIG. 3 part A has been removed from member 22 to form female groove 130 and part B has been removed from member 22″ to form female groove 130″ and longitudinal male tonge portions 134 and 134″ are thereby formed. The cross-sectional area of grooves 130 and 130″ together (i.e. part A plus part B) equals the total cross sectional area of one of the elliptical portions. The flat groove faces 138 and 138″ are coplanar, but need not be on a diameter line of the timber member. In addition as shown in FIG. 4, the flat groove faces 138 and 138″ may be other than coplanar providing they are parallel and the size of the grooves are related as has been described with reference to FIG. 3. Although with either of these alternatives the simplicity of the design and ease of manufacture is diminished due to the use of two cuts of different proportions on each member, the spirit of the invention has been utilized to achieve resistance to forces perpendicular to plane 26 by the shaping of each member with two single cuts in diametrically opposed elliptical sections.

In addition, it will be appreciated that it is not critical that the flat faces of the female grooves be perfectly flat so long as they are shaped so as to co-operate with longitudinally extending male tongue portions in other members created by making a similarly shaped groove in such other member. The arcuate face of the female groove shaped to abut the adjacent external surface of another member need not be shaped to abut the entire adjacent external surface of the other member as illustrated by surfaces 44, 44′, 46 and 46′ of FIG. 2. In fact with timbers of moderately different diameters, the curved wall of the groove of one member will not abut the entire length of the adjacent external surface of the next member but sufficient contact will be made to resist forces perpendicular to plane 26. If necessary filler compounds of the type normally used with timber structures can be used to fill any vacancies.

Finally, it will be appreciated that some members which are intended for placement at the top or bottom of the wall structure being built will have only one such female groove and adjacent male tongue.

What I claim as my invention is:

1. An elongate structural member of generally cylindrical shape disposed about a longitudinal axis and having in its external surface two female grooves, the first of which extends longitudinally of the crown of the member from end to end thereof, the second of which extends longitudinally of the nether side of the member from end to end thereof, each groove having a cross-sectional shape which is uniform throughout its length and which is defined by first and second faces, one of which is flat, while the other is of an arcuate shape corresponding generally to the curvature of the external surface of the member, said groove leaving adjacent thereto a longitudinally extending male tongue bounded by said flat face and part of the uncut external surface of the member, whereby the member can be interfitted with a second similar member having female grooves and male tongues complimentary to said tongues and grooves respectively of the first member, by engaging a tongue of each member in a groove of the other member so that the said flat faces of the tongue and groove of the respective members are generally in contact and a portion of the uncut curved exterior surface of each member lies generally in contact with the arcuate surface defining the groove of the other member.

2. An elongate structural member as claimed in claim 1 in which said flat faces are disposed on a plane extending longitudinally through the centre line of the member.

3. An elongate structural member as claimed in claim 2 wherein said female grooves are substantially identical and disposed diametrically along said plane and on opposite sides of said plane and respectively defining substantially identical adjacent male tongues whereby similar members are interfitted by said engagement of a tongue and groove of the first member and the complimentary groove and tongue respectively of a second member.

4. A wall comprised of a plurality of elongated structural members as claimed in claim 1 interfitted one on top of the other.

5. A wall comprised of a plurality of elongated structural members as claimed in claim 3 interfitted such that said planes of the members are coplanar and the members are interengaged to resist forces acting perpendicular to said planes.

6. An elongate structural member as claimed in claim 1 in which said female grooves are unequal in cross-sectional area and said flat faces, being generally of equal depth, are coplanar and the sum of the lengths of the arcuate faces of said female grooves is equal to the length of one of those arcuate faces if extended in its arcuate shape from one side of the member to the other.

7. An elongate structural member as claimed in claim 1 in which said female grooves are unequal in cross-sectional area and said flat faces, being generally of equal depth, are disposed on a plane extending longitudinally through the member, and the sum of the lengths of the arcuate faces of said female grooves is equal to the length of one of those arcuate faces if extended in its arcuate shape from one side of the member to the other.

8. A wall comprised of a plurality of elongated structural members as claimed in claim 6 interfitted one on top of the other.

9. A wall comprised of a plurality of elongated structural members as claimed in claim 7 interfitted such that said planes of the members are coplanar and the members are interengaged to resist forces acting perpendicular to said planes.

* * * * *